US008425339B2

(12) United States Patent
Basden

(10) Patent No.: US 8,425,339 B2
(45) Date of Patent: Apr. 23, 2013

(54) SYSTEMS AND DEVICES OF ENHANCING POWER GRIP ON AN ATHLETIC APPARATUS

(76) Inventor: Gerald A. Basden, Stone Mountain, GA (US)

( * ) Notice: Subject to any disclaimer, the term of this patent is extended or adjusted under 35 U.S.C. 154(b) by 0 days.

(21) Appl. No.: 13/221,804

(22) Filed: Aug. 30, 2011

(65) Prior Publication Data

US 2012/0052968 A1 Mar. 1, 2012

Related U.S. Application Data

(60) Provisional application No. 61/379,169, filed on Sep. 1, 2010.

(51) Int. Cl.
*A63B 69/36* (2006.01)

(52) U.S. Cl.
USPC ..... 473/205; 473/201; 473/206

(58) Field of Classification Search ..... 473/61, 473/201–206; 2/161.1
See application file for complete search history.

(56) References Cited

U.S. PATENT DOCUMENTS

| | | | | |
|---|---|---|---|---|
| 2,787,003 | A | 4/1957 | Parlanti | |
| 2,863,449 | A | 12/1958 | Spencer | |
| 3,533,405 | A * | 10/1970 | Collins | 602/22 |
| 3,707,730 | A * | 1/1973 | Slider | 2/161.1 |
| 5,312,134 | A | 5/1994 | Goode et al. | |
| 5,453,064 | A | 9/1995 | Williams, Jr. | |
| 6,427,246 | B1 | 8/2002 | Doi et al. | |
| 6,540,621 | B1 * | 4/2003 | Robinson | 473/201 |
| 6,783,507 | B1 * | 8/2004 | Fisher | 602/22 |
| 6,887,212 | B2 * | 5/2005 | Bennett | 602/20 |

* cited by examiner

*Primary Examiner* — Nini Legesse
(74) *Attorney, Agent, or Firm* — Mathew L. Grell; Balser & Grell IP Law

(57) ABSTRACT

The disclosed systems and devices of enhancing power grip on an athletic apparatus allow for a constant pressure by the thumb and index finger to be applied to the golf club. The enhanced grip of the left thumb and index finger is sufficient to maintain proper grip during the golf swing and, most importantly, at impact. The disclosed systems and devices of enhancing power grip on an athletic apparatus comprise an index finger support, a thumb support and a locking mechanism. In an example embodiment, the index finger support comprises a slight curvature (or bevel) which allows this portion of the grip to be on the underside of the golf club. The thumb portion of the grip may be straight, exerting pressure on the top portion of the golf club.

20 Claims, 8 Drawing Sheets

SYSTEMS AND DEVICES OF ENHANCING POWER GRIP ON AN ATHLETIC APPARATUS

CROSS-REFERENCE TO RELATED APPLICATION

This application claims benefit to U.S. provisional patent application Ser. No. 61/379,169, filed on Sep. 1, 2010, which is incorporated by reference herein.

TECHNICAL FIELD

The present disclosure is generally related to athletic apparatuses and, more particularly, is related to enhancing a power grip on an athletic apparatus.

BACKGROUND

A golfer's natural grip involves a right-handed golfer gripping a top portion of a club with his left hand. The left hand is wrapped around the top portion of the golf club. Pressure is exerted with the left thumb on one side of the golf club and equal pressure should be applied by the index finger (first finger) on the left hand on the other side of the golf club. The more pressure exerted by these two fingers, the firmer the golf grip around the golf club. This pressure should remain constant as the golf club is swung backward and then forward through the point of contact with the golf ball. This should result in a straight shot (if other factors are not an issue). If the pressure exerted by the golf grip is reduced during the golf swing, the head of the golf club will twist at the point if contact with the golf ball. This twist may result in a hook or a faded golf shot. There are heretofore unaddressed needs with previous solutions.

SUMMARY

Example embodiments of the present disclosure provide systems and devices of enhancing power grip on an athletic apparatus. Briefly described, in architecture, one example embodiment of the device, among others, can be implemented as follows: a first support member; a second support member; and a locking mechanism configured to lock the relative position of the first support member to the second support member.

Embodiments of the present disclosure can also be viewed as providing methods for systems and devices of enhancing power grip on an athletic apparatus. In this regard, one embodiment of such a system, among others, can be broadly summarized by the following steps: a glove; and a support device configured to fit in the glove, the support device comprising: a first support member; a second support member; and a locking mechanism configured to lock the relative position of the first support member to the second support member.

DETAILED DESCRIPTION

Figure 1:
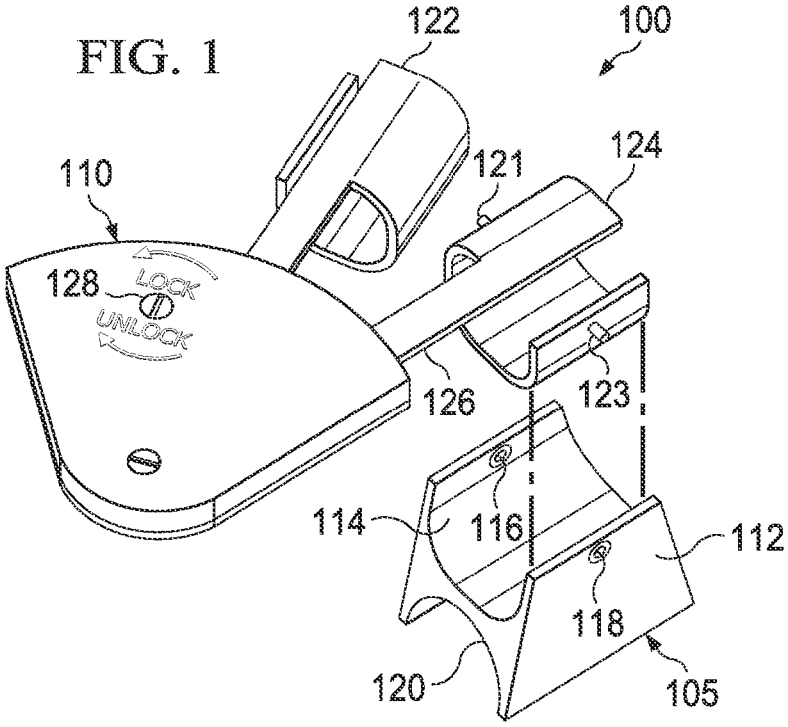
FIG. 1 is a perspective diagram of an example embodiment of a device of enhancing power grip on an athletic apparatus.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

In the game of golf, in order to hit the golf ball, the golf club is swung at a motionless ball. Each shot is a compromise between length and precision, and long shots are often less precise than short shots. A longer shot may result in a better score if it helps to reduce the total number of strokes for a given hole, but the benefit may be more than outweighed by additional strokes or penalties if a ball is lost, goes out of bounds, or comes to rest on difficult ground. Therefore, a skilled golfer must assess the quality of his or her shots in a particular situation in order to judge whether the possible benefits of aggressive play are worth the risks.

Putts and short chips are ideally played without much movement of the body, but most other golf shots are played using variants of the full golf swing. The full golf swing itself is used in tee and fairway shots.

A full swing is a complex rotation of the body aimed at accelerating the club head to a great speed. For a right-handed golfer, the swing consists of a backswing to the right from the players perspective, a downswing to the left (during which the ball is hit), and a follow through. The full golf swing is a complex motion which is difficult to learn. It is common for beginners to spend several months practicing the basics of the swing before playing their first ball on a golf course. Even highly skilled golfers may continue to take golf lessons for years.

A golf ball acquires spin when it is hit. Backspin is imparted for almost every shot due to the golf club's "loft" (i.e., the angle between the clubface and a vertical plane). A spinning ball deforms the flow of air around it similar to an airplane wing; a back-spinning ball therefore experiences an upward force which makes it fly higher and longer than a ball without spin. However, too much backspin can negatively impact distance traveled; the increased lift wastes the ball's momentum in gaining altitude rather than in traveling along its flight path. The amount of backspin also influences the behavior of a ball when it impacts the ground. A ball with little backspin will usually roll out for a few meters or yards while a ball with more backspin may not roll at all, or may even roll backwards.

Sidespin occurs when the clubface is not aligned perpendicularly to the plane of swing. Sidespin makes the ball curve left or right, and can be used intentionally or occur unintentionally. For a right-handed player, a subtle curve to the left is referred to as a "draw". A severe curve to the left and downward is known as a "hook". A subtle curve to the right is referred to as a "fade", while a severe curve away and upward is known as a "slice". Draws and fades are caused by slight misalignments between the clubface and swing plane because of a slightly "open" or "closed" clubface at contact; a skilled player can control the amount of draw or fade to make the ball curve along the path of the fairway. Slices and hooks, however, indicate a severe misalignment, mistiming or other flaw in the player's swing, such as a swing not parallel to the desired line of travel, the club contacting the ball early or late in the swing, etc. These are generally undesirable as they reduce carry distance, are difficult to predict and therefore difficult to adjust for, and cause the ball to veer sharply off of the fairway and into hazards, trees and/or out-of-bounds.

The success of a golf swing requires positioning the player's hands in the correct position and exerting effective, balanced pressure on the grip of the golf club throughout the swing of the club. The hands must function in unison to position the club behind the ball, initiate the back swing, begin the downswing, make contact with the ball and complete the follow through. If the hands do not maintain sound, effective control of the club then the accuracy, direction of flight, and shot distance are negatively affected, which influences the resulting score of the game.

For many golfers, there is a tremendous tendency for the thumb and index finger of the golfer's dominant hand (right or left) to exert excessive clenching force during the grip to excessively control the club, which ultimately negatively impacts the golfer's swing. Excessive control by these two fingers can cause the club face angle to be too far open or closed at the point of impact, with the ball causing a push or fade of the shot.

Such clenching of the grip may also cause the wrists to stay open too long or roll over prematurely, resulting in slicing or hooking of the ball. If these two fingers and the related muscle groups of the corresponding side of the body excessively dominate the swing, then the golfer will make inconsistent, unpredictable contact with the ball, resulting in erratic, undesirable performance.

The disclosed systems and devices of enhancing power grip on an athletic apparatus allow for a constant pressure by the thumb and index finger to be applied to the golf club. The enhanced grip of the left thumb and index finger is sufficient to maintain proper grip during the golf swing and, most importantly, at impact. The disclosed systems and devices of enhancing power grip on an athletic apparatus comprise an index finger support, a thumb support and a locking mechanism. In an example embodiment, the index finger support comprises a slight curvature (or bevel) which allows this portion of the grip to be on the underside of the golf club. The thumb portion of the grip may be straight, exerting pressure on the top portion of the golf club.

When the pressure exerted from both fingers is applied, the locking mechanism may be engaged to lock that pressure on the golf club, supporting and maintaining the pressure exerted by the thumb. Once the mechanism is locked, the golf club becomes an extension of the arm. The pressure exerted by the golf grip remains constant as the golf club is swung backward and then forward through the point of contact with the golf ball. This consistency in the grip results in a straighter golf shot with an easier golf swing.

An example embodiment of the disclosed systems and methods is inserted within a glove, such as a non-limiting example of a golf glove. In this example embodiment, the golf glove may provide support. It serves the purpose of strengthening the golf grip on the golf club by being supported on a user's hand. It could be embedded in the golf glove but it may be sold stand-alone as well. Example embodiments of the disclosed systems and methods may have the effect of alleviating a medical condition (e.g. arthritis in the hands or fingers) by offering gripping support for holding an athletic apparatus such as a golf club.

An example embodiment includes a thumb support and an index finger support. In a right-handed player the disclosed device is used on the left hand so when the club is gripped, the thumb is locked and the device fits onto the golf club. The index finger fits into the index finger support and then may be secured in place with various securing mechanisms such as hook and loop, snap, etc. The index finger support may be adjusted to the finger size. The locking mechanism of the thumb support may be integrated into the thumb support. In an example embodiment, teeth in the thumb support push down onto the index finger support. A lock may be enabled by using a cam switch, as a non-limiting example. In an example embodiment, when the cam switch is activated, it applies pressure to the teeth which "bite" onto the index finger support of the second support member. The locking mechanism may be operated in an opposite manner such that the index finger support has the teeth and it bites onto the thumb support. In an example embodiment, the enclosing mechanism on the finger is not used on the thumb support. The thumb support may comprise a cut-out on the bottom of the thumb area so that the thumb may mate with the club and apply the pressure. The fleshy part of the user's thumb is then applying pressure on the golf club grip. When the user grips the golf club, the hand is still holding the club. The section of the thumb between the palm and the knuckle applies the pressure to the club.

FIG. 1 provides example embodiment 100 of a system of providing a power grip on an athletic apparatus. System 100 comprises index finger support 122, thumb support 124 and top plate 110. Top plate 110 comprises locking mechanism 128 for locking the relative positioning of index finger support 122 and thumb support 124. In the example embodiment of FIG. 1, locking mechanism 128 comprises a screw to maintain the relative positioning of thumb support 124 and index finger support 122. Other example embodiments include a toothed plate, hook and loop, slot and pin, and/or a sliding plate that may be pushed forward from the back of the device to lock and pulled backward to unlock. In an example embodiment, system 100 includes cradle or receiver 105 which mates with the athletic apparatus, such as a golf club. Receiver 105 comprise a outside face 112, inside face 114, bottom face 120, first hole 116 and second hole 118. Bottom face 120 removably attaches to the handle of the athletic apparatus and thumb support 124 removably attaches to receiver 105, mating with inside face 114. In example embodiment, pins 121 and 123 fit in first hole 116 and second hole 118 respectively. Pins 121 and 123 may be spring loaded pins, balls, or other non-limiting examples of removably connecting mechanisms.

Figure 2:
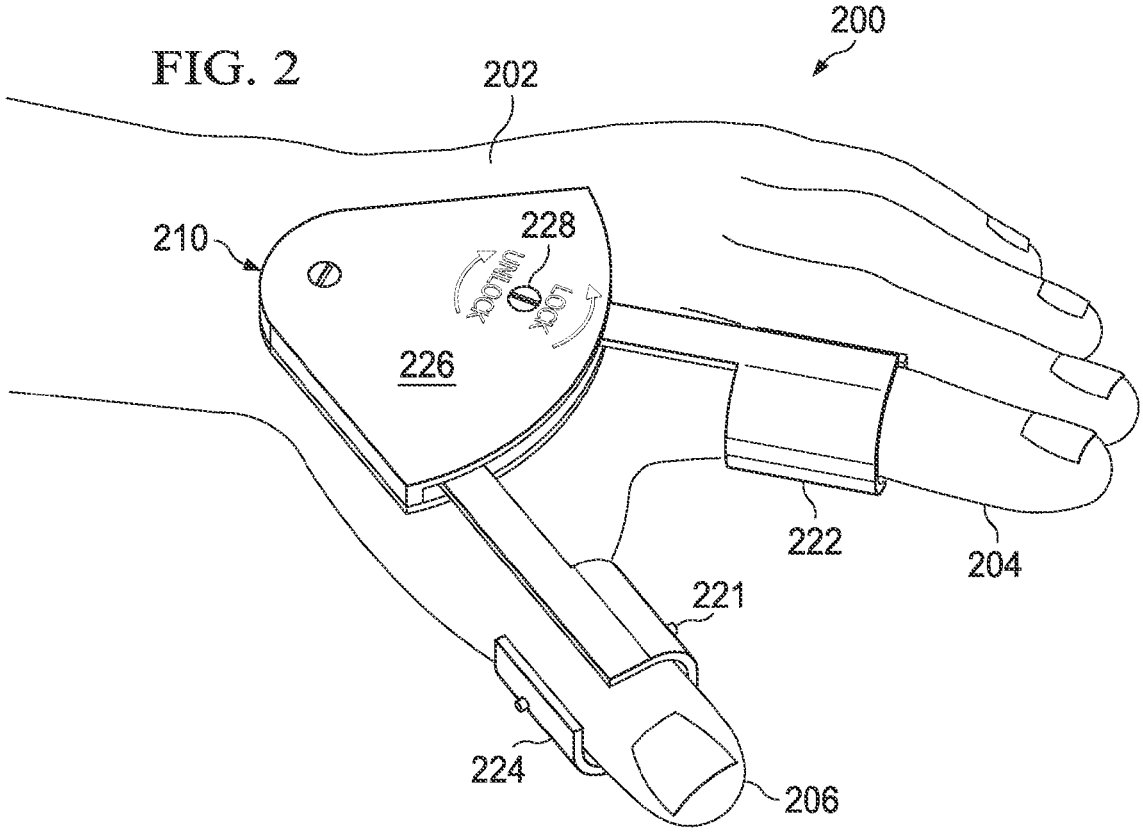
FIG. 2 is a perspective diagram of an example embodiment of a device of enhancing power grip on an athletic apparatus installed on a hand.

FIG. 2 provides diagram 200 of system 210 placed on user's hand 202. System 210 comprises index finger support 222, thumb support 224, top plate 226, locking mechanism 228, and pin 221. Pins 221 and 223 may be spring loaded pins, balls, or other non-limiting examples of removably connecting mechanisms. Index finger support 222 fits around index finger 204, and thumb support 224 fits around thumb 206. In an example embodiment, top plate 226 maintains the integrity of system 210. Locking mechanism 228 maintains the relative positioning of index support 222 to thumb support 224.

Pins 221 and 223 may be used to attach system 210 to a receiver that is positioned on an athletic apparatus, such as a golf club, enabling a user to apply constant pressure on the apparatus.

Figure 3A:
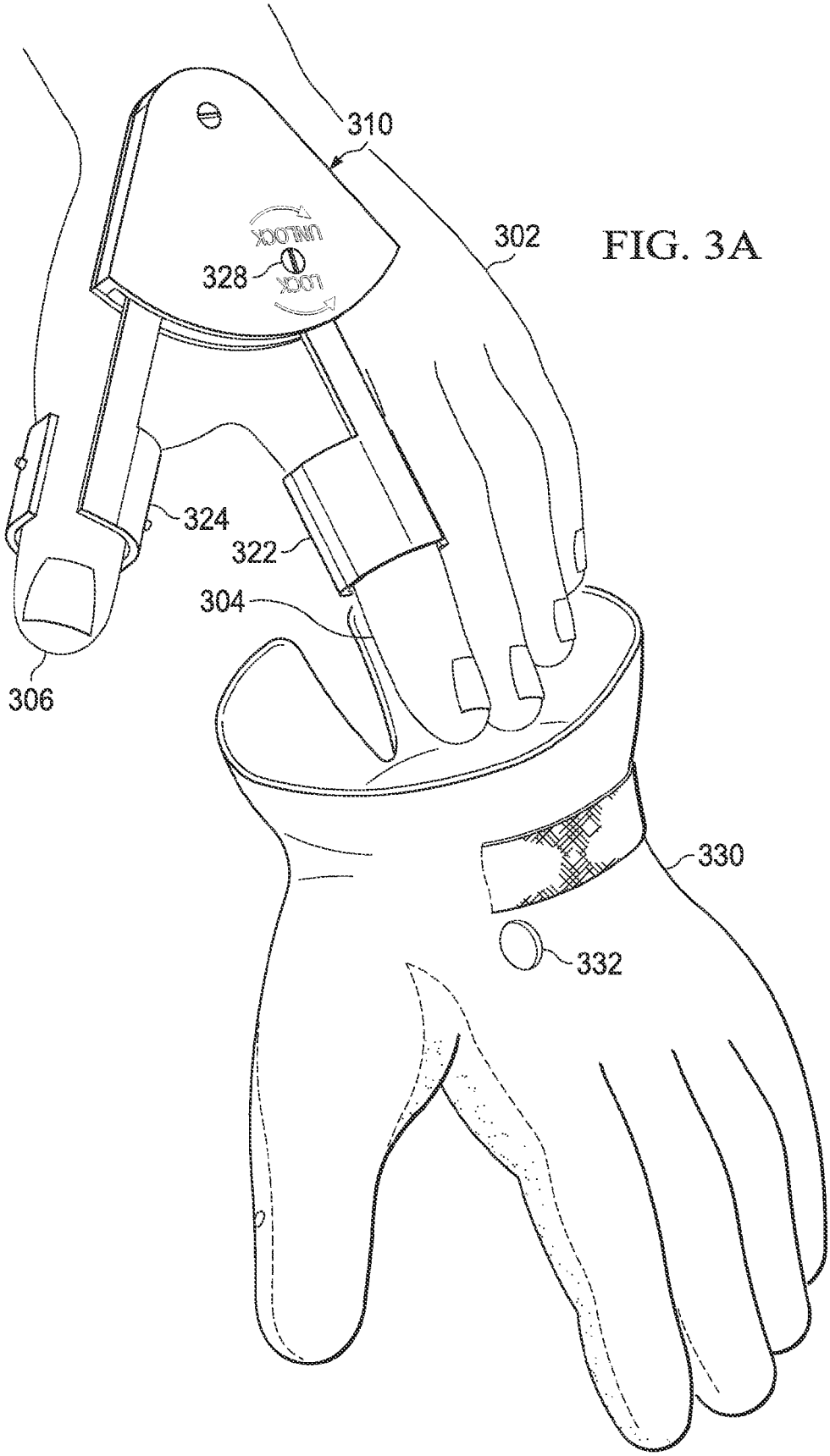
FIG. 3A is a perspective diagram of an example embodiment of the device of FIG. 2 in preparation for placement in a glove.

FIG. 3A provides a diagram of system 310 applied to user's hand 302 as it fits within an athletic glove. In this example embodiment, the athletic glove is a golf glove, but the system may be applied to other athletic gloves as well, such as a non-limiting example of a racquetball racquet. The apparatus may be used on the opposite hand for use with a racquetball racquet since only one hand is used. Glove 330 may be configured to receive hand 302 with system 310 in place on user's hand 302 with index finger support 322 on index finger 304 and thumb support 324 on thumb 306. Glove 330 may be configured with opening 332 such that locking mechanism 328 is accessible to lock the relative positioning of index finger support 322 and thumb support 324.

Figure 3B:
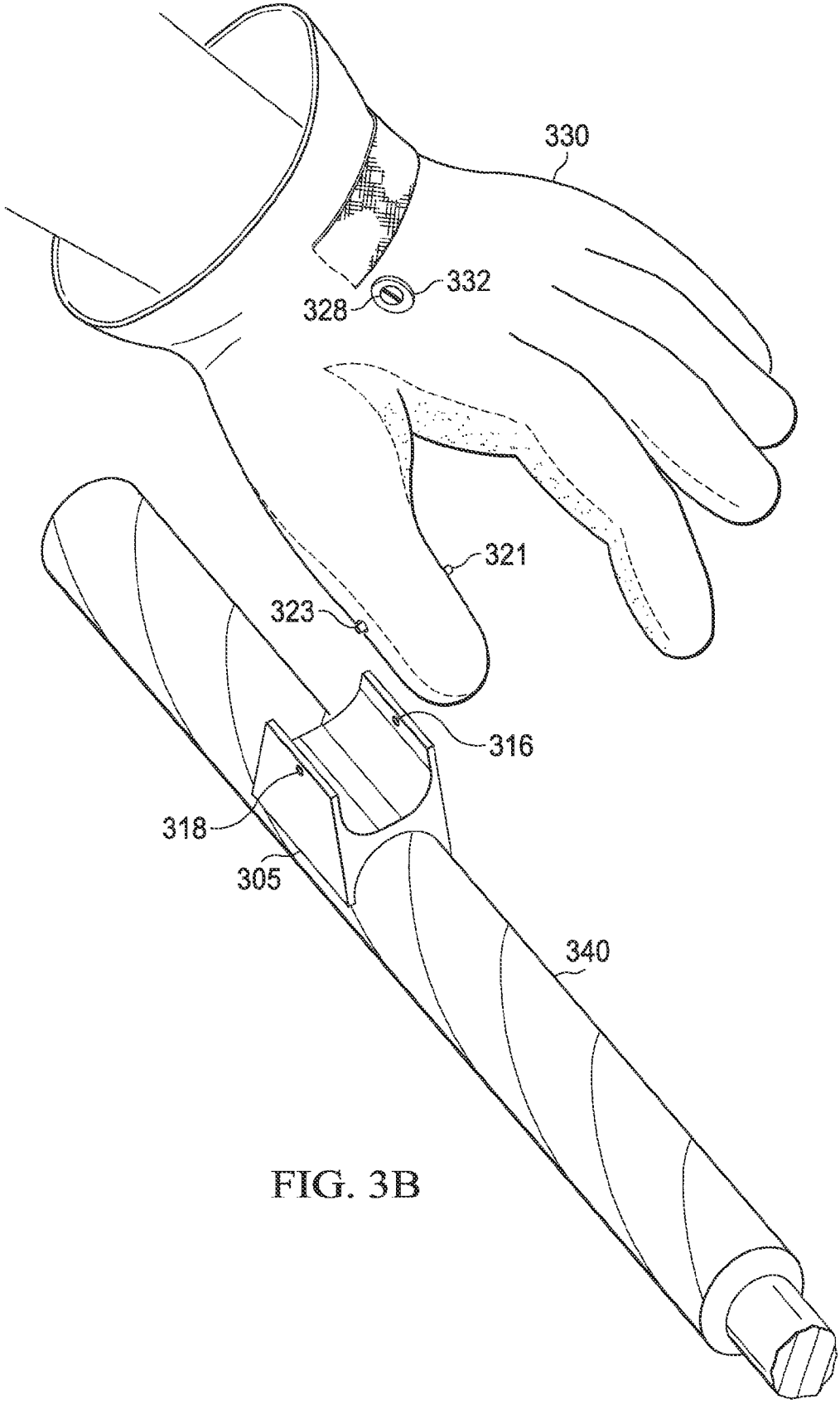
FIG. 3B is a perspective diagram of an example embodiment of the device of FIG. 2 inserted in a glove in preparation for insertion in a cradle.

FIG. 3B provides a diagram of hand 302 with an example embodiment of system 310 installed within glove 330 as configured to attach to receiver 305. Receiver 305 may be mated with athletic apparatus 340, a golf club in this example embodiment. Locking mechanism 328 may be accessible through opening 332. Attachment mechanism 321 and 323 are configured to fit in openings 316 and 318 to attach system 310 to receiver 305 through glove 330.

Figure 4:
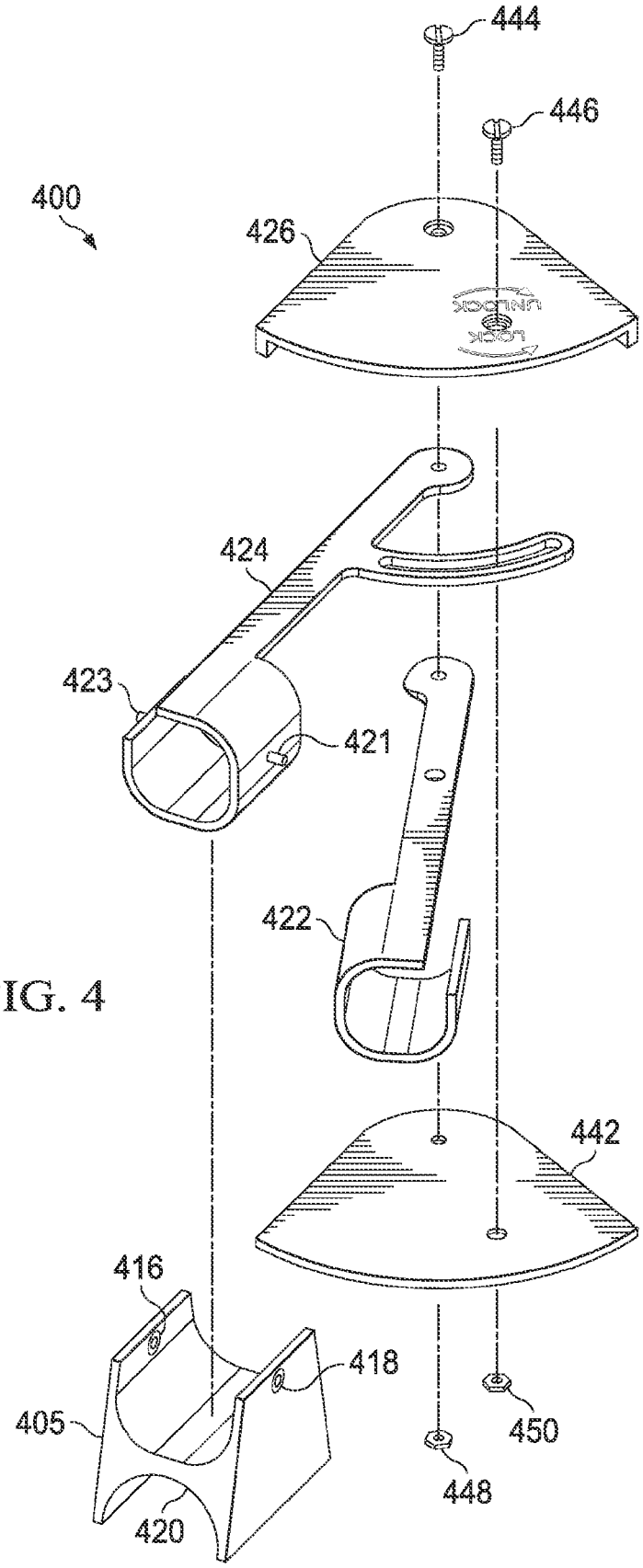
FIG. 4 is an exploded view diagram of an example embodiment of the device of FIG. 1.

FIG. 4 provides an exploded view of an example embodiment of a system of enhancing power grip on an athletic apparatus. System 400 comprises index finger support 422, thumb support 424 with attachment means 421 and 423, top plate 426, and bottom plate 442. In this example embodiment, attachment device 444 (for example, a screw, a pin, rivet, etc.) acts as a pivot point for index finger support 422 and thumb support 424. Attachment device 444 also may act to attach top plate 426 to bottom plate 442. Nut 448 may be used to secure attachment device 444 if attachment device 444 is a screw. Alternatively, nut 448 or other securing mechanism may be integrated into bottom plate 442. In this example embodiment, the locking mechanism is screw 446 that passes through an adjustment mechanism in thumb support 424. In an alternative embodiment, the adjustment mechanism could be in index finger support 422. Nut 450 may be used to secure locking mechanism 446 if locking mechanism 446 is a screw. Alternatively, nut 450 or other securing mechanism may be integrated into bottom plate 442. In this example embodiment, pins 421 and 423 fit in holes 416 and 418 of receiver 405. Bottom face 420 mates with an athletic apparatus such as a golf club to maintain the position of the thumb on the athletic apparatus.

Figure 5:
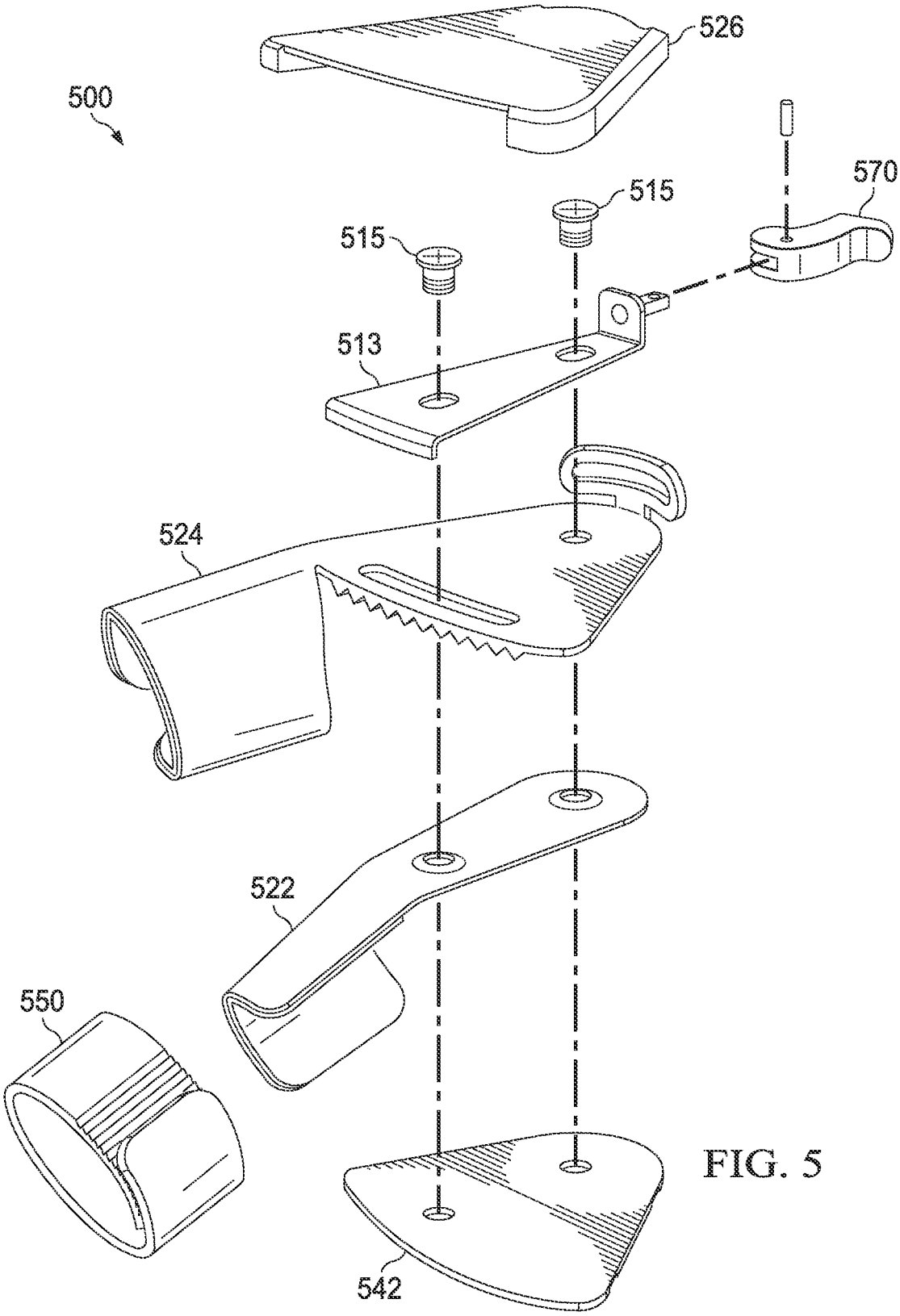
FIG. 5 is an exploded view diagram of an alternative example embodiment of a device of enhancing power grip on an athletic apparatus

FIG. 5 provides an alternative example embodiment of a system of providing a power grip on an athletic apparatus. System 500 may comprise top plate 526, cam plate 513, cam lever 570, thumb support 524, index finger support 522, bottom plate 542, and finger securing mechanism 550. Attachment device 515 operates to hold cam plate 513, thumb support 524, index finger support 522 and bottom plate 542 together. Attachment means 515 also acts as a pivot point around which thumb support 524 and index finger support 522 rotate around the pivot point provided by attachment device 515. In an example embodiment, attachment device 515 is a screw, but other non-limiting embodiments include a rivet and a pin. Attachment device 515 may also act as an adjustment mechanism by passing through an adjustment opening in thumb support 524. The adjustment opening may be located in one or both of thumb support 524 and index finger support 522. Cam plate 513 may act to apply pressure to thumb support 524, forcing the teeth of thumb support 524 to bite into slots located at the end of cam plate 513 and/or index finger support 522 depending on the configuration, thereby locking the relative position of thumb support 524 and index finger support 522. Alternatively, the teeth may be located on index finger support 522 and applied against thumb support 524 when cam plate 513 is engaged using cam lever 570. Finger securing mechanism 550 may secure a user's index finger in index finger support 522. Finger securing mechanism 550 may be held closed by many securing means, such as, but not limited to hook and loop fasteners, ratcheting fasteners, and plastic skin coating.

Figure 6:
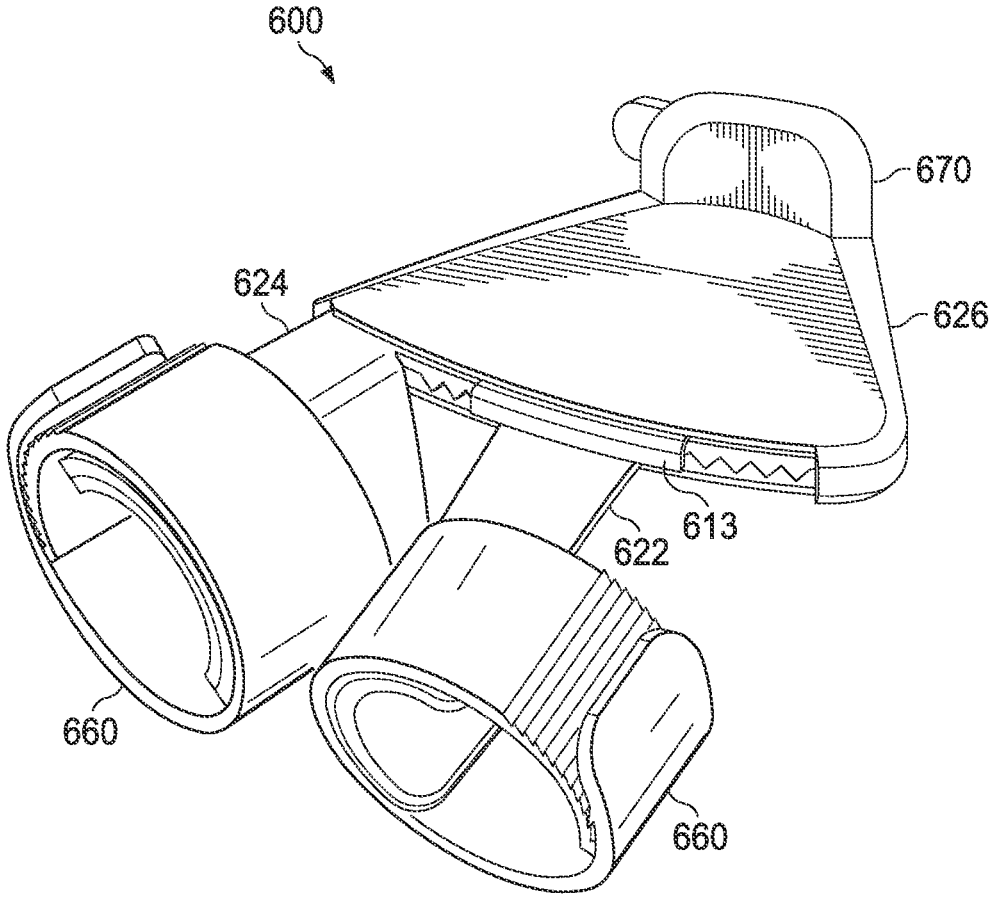
FIG. 6 is a perspective view diagram of an example embodiment of the device of FIG. 5.

FIG. 6 provides diagram 600 of the exploded view of FIG. 5 comprising thumb support 624, index finger support 622, top plate 626, cam plate 613, locking device 670, and finger securing mechanisms 660. A user's thumb and index finger fit into thumb support 624 and index finger support 622 respectively, and are secured in place by finger securing mechanisms 660. Securing device 670 may be a cam lever as provided in this example embodiment, which applies pressure to cam plate 613, causing the teeth of either thumb support 624 or index finger support 622 into the other support. Attachment mechanism 670 may be accessible through the wrist opening of the athletic glove.

Figure 7:
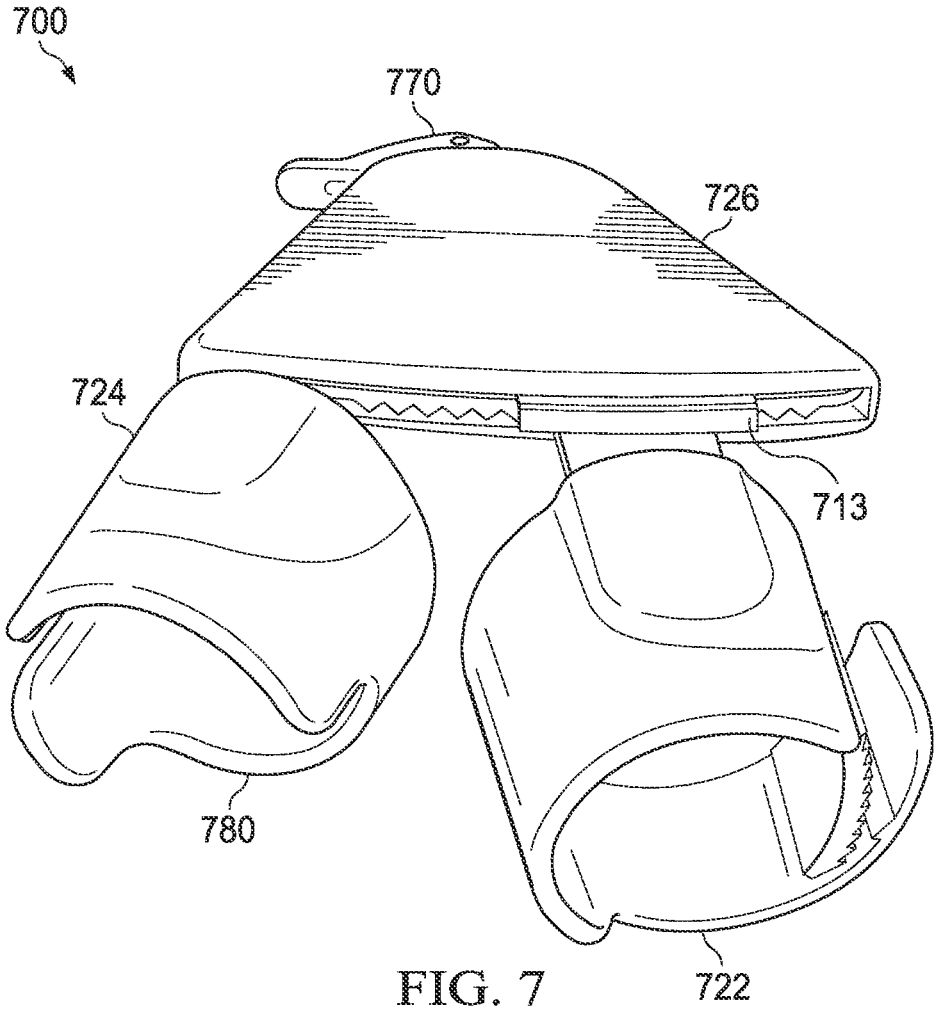
FIG. 7 is a perspective view diagram of an alternative example embodiment of the device of FIG. 6.

FIG. 7 provides a topside view of system 700 for providing a power grip on an athletic apparatus. System 700 comprises cam lever 770, cam plate 713, top plate 726, thumb support 724 and index finger support 722. In this example embodiment, thumb support 724 has cut out area 780 along the bottom so that the user's thumb may apply pressure to the athletic apparatus.

Figure 8:
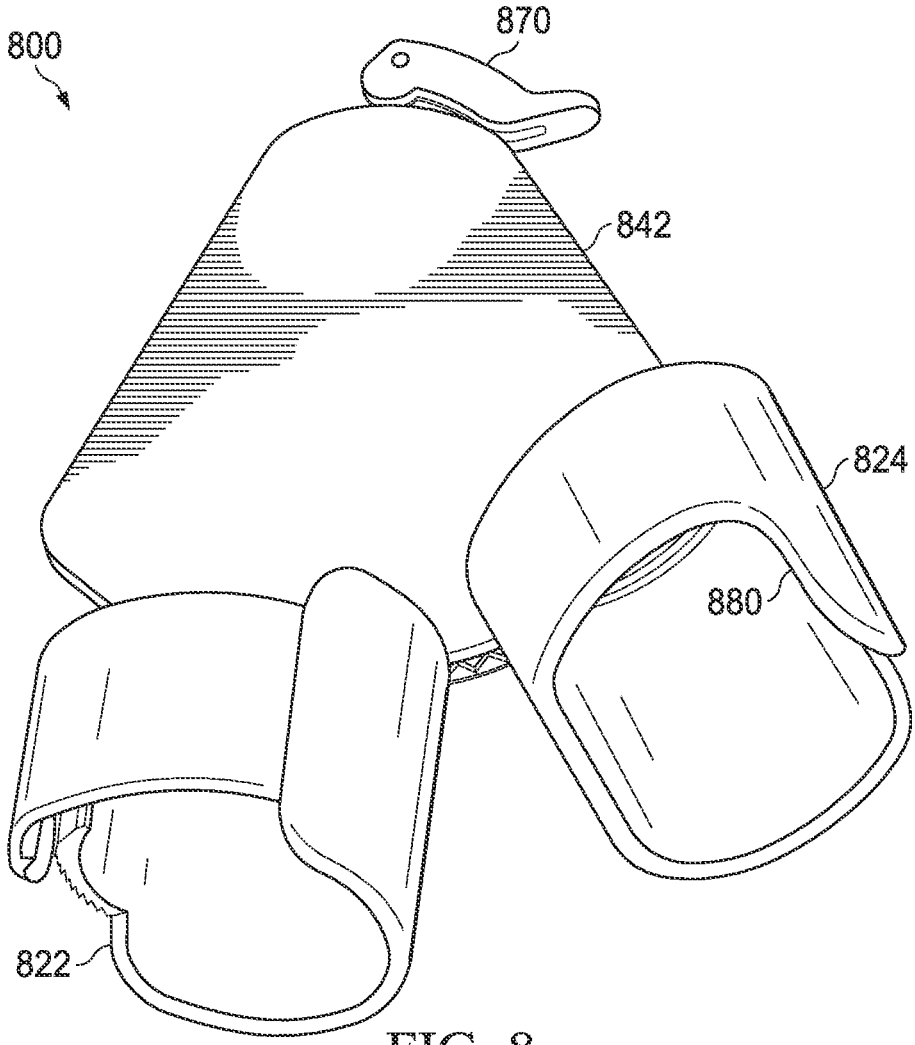
FIG. 8 is a perspective view diagram of an example embodiment of the device of FIG. 7.

FIG. 8 provides a bottom view of system 800 for providing a power grip on an athletic apparatus. System 800 comprises cam lever 870, bottom plate 842, thumb support 824 and index finger support 822. In this example embodiment, thumb support 824 has cut out area 880 along the bottom so that the user's thumb may apply pressure to the athletic apparatus.

Although the present disclosure has been described in detail, it should be understood that various changes, substitutions and alterations can be made thereto without departing from the spirit and scope of the disclosure as defined by the appended claims.

Therefore, at least the following is claimed:

1. A system comprising:

a glove; and a support device configured to fit in the glove, the support device comprising:

a first support member;

a second support member;

a pivot point to enable rotational movement between said first support member and said second support member; and a locking mechanism configured to lock the relative position of the first support member to the second support member.

2. The system of claim 1, further comprising a cradle configured to mate with the handle of an athletic apparatus and to receive the second support member.

3. The system of claim 2, wherein the second member comprises at least one connection prong, the at least one connection prong configured to removably connect with the cradle, and to pass through the glove to connect with the cradle.

4. The system of claim 1, wherein the locking mechanism is accessible through an opening in the glove when the glove is fully engaged with a hand.

5. The system of claim 1, wherein the glove comprises a golf glove.

6. The system of claim 1, wherein the first support member is configured to receive an index finger and the second support member is configured to receive a thumb.

7. The system of claim 1, wherein the second member comprises a open section configured to allow a thumb inserted in the second member to mate with an athletic apparatus.

8. A device configured to fit in a glove, the device comprising:

a first support member;

a second support member;

a pivot point to enable rotational movement between said first support member and said second support member; and a locking mechanism configured to lock the relative position of the first support member to the second support member.

9. The system of claim 8, further comprising a cradle configured to mate with the handle of an athletic apparatus and to receive the second support member.

10. The system of claim 9, wherein the second member comprises at least one connection prong, the at least one connection prong configured to removably connect with the cradle, and to pass through the glove to connect with the cradle.

11. The system of claim 8, wherein the locking mechanism is accessible through an opening in the glove when the glove is fully engaged with a hand.

12. The system of claim 8, wherein the glove comprises a golf glove.

13. The system of claim 8, wherein the first support member is configured to receive an index finger and the second support member is configured to receive a thumb.

14. The system of claim 8, wherein the second member comprises an open section configured to allow a thumb inserted in the second member to mate with an athletic apparatus.

15. A device, comprising:

a receiver configured to be removably attached to a handle of a golf club;

a support device configured to fit on a user hand, the support device further configured to maintain the positioning of the thumb and index finger of the hand on the golf club, wherein the thumb and index finger rotate about a pivot point therebetween, the support device further configured to be received by the receiver.

16. The device of claim 15, wherein the positioning of the thumb and index finger by the support device is lockable.

17. The device of claim 15, further comprising a golf glove configured to removably receive the support device.

18. The device of claim 15, wherein the support device attachment to the receiver is maintained by a connection prong.

19. The device of claim 15, further comprising a locking mechanism configured to lock the relative position of the thumb and index finger.

20. The device of claim 19, wherein the locking mechanism is at least one of a cam for applying pressure to locking teeth and a screw.

* * * * *